US006153015A

United States Patent [19]

Geldner et al.

[11] Patent Number: 6,153,015

[45] Date of Patent: Nov. 28, 2000

[54] PROCESS FOR REMOVING SOAP-CONTAMINATED CONVERSION LAYERS ON METAL WORKPIECES

[75] Inventors: Joachim Geldner, Friedrichsdorf; Klaus Wittel, Frankfurt am Main; Georg Bluemlhuber, Oberasbach, all of Germany

[73] Assignee: Metallgesellschaft AG, Frankfurt, Germany

[21] Appl. No.: 09/202,016

[22] PCT Filed: Apr. 18, 1997

[86] PCT No.: PCT/EP97/01966

§ 371 Date: Dec. 8, 1998

§ 102(e) Date: Dec. 8, 1998

[87] PCT Pub. No.: WO97/43462

PCT Pub. Date: Nov. 20, 1997

[30] Foreign Application Priority Data

May 10, 1996 [DE] Germany ..... 196 18 899

[51] Int. Cl.[7] ..... C23G 1/02

[52] U.S. Cl. ..... 134/3; 134/2; 134/10; 134/13; 134/26; 134/28; 134/41; 134/42; 510/254; 510/260; 510/263; 510/264; 510/269; 510/274; 510/362; 510/433

[58] Field of Search ..... 134/2, 3, 10, 13, 134/26, 28, 41, 42; 510/254, 260, 263, 264, 269, 274, 362, 433

[56] References Cited

U.S. PATENT DOCUMENTS

| | | | |
|---|---|---|---|
| 3,552,404 | 1/1971 | Kuhn | 134/64 |
| 3,923,539 | 12/1975 | Jorns | 134/2 |
| 3,969,135 | 7/1976 | King et al. | 134/41 |
| 4,400,289 | 8/1983 | Geldner et al. | 252/142 |
| 4,415,415 | 11/1983 | Zaremski | 204/141.5 |
| 4,517,029 | 5/1985 | Sonoda | 148/6.152 |
| 4,609,488 | 9/1986 | Geke et al. | 252/344 |
| 5,501,741 | 3/1996 | McMahon | 134/13 |

FOREIGN PATENT DOCUMENTS

| | | |
|---|---|---|
| 0 275 043 A1 | 7/1988 | European Pat. Off. . |
| 0 898 621 B1 | 3/1999 | European Pat. Off. . |
| 38 43 148 A1 | 6/1990 | Germany . |
| 59700669 | 12/1999 | Germany . |

OTHER PUBLICATIONS

Siemund, G.: "Schmieren Und Phosphatieren Beim Kaltumformen Kombinieren", "Drahtwelt", Heft 11/83, Vogel–Verlag Wuerzburg, pp. 2–4. (Translation is provided).

Clariant Product Sheets, Publishes May 23, 2000 pp. 1–6.

Condea Product Sheet Published Jan. 1998, pp. 1–5.

*Primary Examiner*—Sharidan Carrillo
*Attorney, Agent, or Firm*—Michael J. Striker

[57] ABSTRACT

The process for removing a soap-contaminated conversion layer remaining on a metal workpiece after cold-forming with an aqueous acidic cleaning composition containing water, a surfactant such as an alkyl amine ethoxylate and nitric acid, phosphoric acid and/or amidosulphonic acid includes immersing the contaminated metal workpiece in the aqueous acidic cleaning composition at a temperature above 60° C. until it has a clean bright surface and a fatty acid formed by reaction of the soap in the conversion layer is dispersed in the cleaning composition and then subsequently separating the metal workpiece from the cleaning solution and, after the separating, cooling the recovered aqueous acidic cleaning composition to a temperature below 55° C. until a fatty acid layer including the fatty acid is separated from the aqueous acidic cleaning composition. The fatty acid layer is removed from the aqueous acidic cleaning composition to form a reusable aqueous acidic cleaning composition and then other metal workpieces are cleaned with the reusable aqueous acidic cleaning composition.

5 Claims, No Drawings

PROCESS FOR REMOVING SOAP-CONTAMINATED CONVERSION LAYERS ON METAL WORKPIECES

BACKGROUND OF THE INVENTION

1. Field of the Invention

This invention relates to a process for removing soap-contaminated conversion layers remaining on metal workpieces after cold-forming by means of aqueous, acid cleaning agents as well as the use thereof for cleaning soap-contaminated calcium aluminate coatings remaining on workpieces of aluminium or aluminium alloys after cold-forming.

In connection with the industrial manufacture of workpieces by means of a non-cutting cold-forming operation, it is for instance necessary to remove remaining lubricant-contaminated phosphate, oxalate or aluminate coatings, so-called soaked-in phosphate, oxalate or aluminate coatings. As lubricant, in particular oils and soaps are used, which chemically react with the previously applied phosphate, oxalate or aluminate coating, thereby forming an intimate bond. The preparation of cold-forming by applying phosphate, oxalate and aluminate coatings and the subsequent treatment with lubricants is commonly used in particular in the field of tube drawing, wire drawing, cold extrusion or sinking.

The above-mentioned soaked-in coatings must be removed above all when it is for instance intended to perform a soft annealing of the workpiece, a further chemical surface treatment or a lacquer coating.

2. Prior Art

The acid cleaning of aluminium, in particular of cold-formed aluminium is known and described for instance in U.S. Pat. No. 3,969,135 with respect to the cleaning of aluminium cans provided with lubricant residues, which cans were produced by deep-drawing or sinking from thin round sheet metal blanks. As a basis of the acid cleaning agent, there is used sulfuric acid with a minor addition of hydrofluoric acid. A further acid cleaning agent for aluminium or aluminium alloys is described in EP-A-275,043. As basis there is used a mineral acid from the group including sulfuric acid, phosphoric acid and nitric acid. Both the aforementioned processes have in common that the aluminium or aluminium alloy surface was formed without preceding conversion treatment by merely using lubricant.

The DE-A-3,843,148, however, describes a process for removing soaked-in conversion and soap layers with alkaline cleaning agents and under the influence of ultrasound. After a correspondingly high load, the constituents of the detached conversion layers accumulate in the cleaning bath, and the bath must be disposed of, which is generally effected by means of a breakdown with acid. It is a disadvantage of this process that major amounts of a strongly alkaline solution must not only be neutralized, but also greatly acidified. In the alkaline cleaning especially of aluminium or aluminium alloys it is furthermore disadvantageous that when using strongly alkaline cleaning agents the material is solubilized, or when using mild alkaline cleaning agents, an only very slow and incomplete detachment of the lubricant-contaminated conversion layer is effected even under the influence of ultrasound.

SUMMARY OF THE INVENTION

It is the object underlying the invention to provide a process for removing soap-contaminated conversion layers remaining on metal workpieces after cold-forming by means of aqueous cleaning agents, which process eliminates the known, in particular the aforementioned disadvantages and provides for a long dwell time of the cleaning agent.

This object is solved in that the process as described above is developed such that the cleaning by means of a cleaning agent containing nitric acid, phosphoric acid and/or amido-sulphonic acid is performed at a temperature above 60° C., and the cleaning agent is cooled after a sufficiently high load in the absence of the cleaned workpieces to a temperature below 55° C., the fatty acid layer floating up is separated, and at least the greater portion of the aqueous phase is reused for cleaning workpieces.

By means of the inventive process, the soaked-in, soap-contaminated conversion layers are removed from the workpiece quickly and completely. The fatty acid formed from the soap remains dispersed in the cleaning agent at the employed cleaning temperatures of above 60° C., so that another deposition of fatty acid onto the workpieces is reliably avoided.

After a sufficiently high load of the cleaning agent, the same is cooled to a temperature below 55° C. The fatty acid floats up and can be separated most easily. Cooling and removal of fatty acid may be effected in the cleaning bath itself, e.g. by means of stripping. This measure leads to the fact that the cleaning treatment must be interrupted temporarily. For the case that this is not desired, part of the loaded cleaning agent can be withdrawn from the cleaning bath, be cooled in a separate device, and be liberated from fatty acid floating up. The separation can likewise be effected by means of stripping, but in the case of this procedure, the separation of the fatty acid by means of filtration or centrifugation should be preferred.

When removing the soaked-in conversion and soap layers, acid is consumed due to a chemical reaction. In accordance with an advantageous aspect of the invention it is therefore provided to adjust the aqueous phase to be reused for cleaning to the nominal concentration of the cleaning-efficient components, in particular the acid. The amount of acid to be added can easily be determined by means of an acid-base titration.

In accordance with a further preferred embodiment of the invention, cleaning is effected with a cleaning agent containing a surfactant. Surfactants on the basis of alkylamine ethoxylates are particularly advantageous. Alkylamine ethoxylates react cation-actively in an acid medium, and nonionogenically in a neutral medium. Examples for such surfactants are GENAMIN® C100 of Hoechst AG, described as ethoxylated coconut fatty amine containing 10 mol ethylene dioxide per molecule, or MARLAZIN® L10 of Chemische Werke Hüls AG, described as fatty amine ethoxylate.

In addition to a considerable extension of the dwell time of the cleaning agent by periodically separating the fatty acid floating up, the process in accordance with the invention in particular offers the advantage that workpieces of aluminium or aluminium alloys can perfectly be cleaned.

The advantages of the inventive process are particularly pronounced when in accordance with a further aspect of the invention the process is applied to the cleaning of soap-contaminated calcium aluminate coatings remaining on work-pieces of aluminium or aluminium alloys after cold-forming. In conjunction with soap, aluminate coatings are preferably used as conversion layers on thick-walled aluminium work-pieces, see also G. Siemund "Schmieren und Phosphatieren beim Kaltumformen kombinieren", Drahtwelt, issue no. 11, 1963.

DETAILED DESCRIPTION OF THE INVENTION

The invention will now be explained by way of example and in detail with reference to the following examples.

EXAMPLES

Shock absorber tubes are produced by cold extrusion from round aluminium blanks, which prior to forming had been provided with a conversion layer of calcium aluminate and had subsequently been treated with a reactive soap. Upon forming, the coating of calcium aluminate and soap was about 10 g/m$^2$. The shock absorber tubes were cleaned in accordance with the invention by means of immersion at 70° C. for a period of 10 minutes, subsequently rinsed with water and dried. In the process in accordance with the invention the following cleaning agents were used:

| | | |
|---|---|---|
| Cleaning agent A: | 5% | $HNO_3$ (100%) |
| | 0.2% | Genamin ® C100 (Hoechst AG) |
| | rest | water |
| Cleaning agent B: | 2% | amidosulphonic acid (100%) |
| | 0.3% | (Genamin ® C100 (Hoechst AG) |
| | rest | water |

By way of comparison, the subsequently described cleaning agents were used:

| | | |
|---|---|---|
| Comparative cleaning agent 1: | 80 g/l | sodium hydroxide |
| | 20 g/l | sodium gluconate |
| | 5 g/l | sodium dodecyl-benzenesulfonate |
| | rest | water |
| Comparative cleaning agent 2: | 20 g/l | $H_2SO_4$ |
| | rest | water |
| Comparative cleaning agent 3: | 20 g/l | HCl |
| | 3 g/l | Genamin ® C100 (Hoechst AG) |
| | rest | water |

The cleaning experiments performed with the above-mentioned cleaning agents led to the following result: Comparative cleaning agent 1 turned out to be completely useless. In addition to a considerable generation of hydrogen, the surfaces of the workpieces were rough, stained and dull upon rinsing.

Comparative cleaning agent 2 initially led to clean, bright surfaces. But after the throughput of a few workpieces, a crystalline coating remained on the surface of the shock absorber tubes upon cleaning the same, which coating was also maintained upon adding cleaning-efficient components and increasing the acid concentration. On the surface of the cleaning bath, there was additionally deposited a greasy film, which substantially consisted of fatty acid and persistently adhered to the treated parts. Cleaning with comparative cleaning agent 3 also produced clean surfaces first of all. But there was observed some pitting easily recognizable with the naked eye.

On the other hand, the results achieved with cleaning agents A and B were satisfactory in every respect. There were not only achieved clean, bright surfaces, but the cleaning effect remained perfect even after an extended throughput of the workpieces. The cleaning agents turned milky during their usage, but upon rinsing the workpieces could still completely be wetted with water.

In order to maintain the cleaning effect of cleaning agents A and B, a bath sample of 5 ml was withdrawn at certain intervals and titrated with 0.1 n sodium hydroxide solution against bromocresol green as indicator. The consumption of 1 ml 0.1 n sodium hydroxide solution corresponds to about 2 g/l free amidosulphonic acid or 1.3 g/l nitric acid. Corresponding to the titration result, the cleaning agents A and B were completed with amidosulphonic acid or nitric acid as well as with the surfactant GENAMIN® C100 (ethoxylated coconut fatty amine containing 10 mol ethylene dioxide per molecule) in the same proportion as when preparing the cleaning agent.

After a throughput of 2500 m$^2$ workpiece surface per m$^3$ cleaning agent, the temperature of the cleaning bath was decreased to 45° C. The dispersed fatty acid solidified, floated up in granular, compact form, and was skimmed off.

After another completion of the cleaning-efficient components to the initial concentration, the cleaning agent was again fully usable.

In a further experiment, phosphatized, soap-contaminated and subsequently pressed steel screws were treated at 65° C. in a rotating drum for 10 minutes in a cleaning agent of the following composition, subsequently rinsed with water and dried.

The cleaning agent contained 150 g/l phosphoric acid 1 g/l FERHIBIT® S, a pickling inhibitor of CHEMETALL GmbH 2 g/l MARLAZIN® L10 (fatty amine ethoxylate)

rest water

Due to the aforementioned treatment, the phosphate and soap coating was completely removed. The concentration of cleaning-efficient components in the cleaning agent was monitored by titration, consumed acid as well as other constituents of the cleaning agent were completed as described above. The regeneration of the loaded cleaning agent was effected by cooling to 40° C., removing the granular fatty acid floating up, and readjusting the cleaning-efficient components to the original concentration. The cleaning agent could be maintained efficient for several weeks.

What is claimed is:

1. A process for removing a soap-contaminated conversion layer remaining on a metal workpiece after cold-forming the metal workpiece, wherein said soap-contaminated conversion layer comprises a soap and at least one member selected from the group consisting of phosphates, oxalates and aluminates, said process comprising the steps of:

a) providing an aqueous acidic cleaning composition comprising water and at least one acid ingredient selected from the group consisting of nitric acid, phosphoric acid and amidosulphonic acid;

b) immersing the metal workpiece with the soap-contaminated conversion layer in the aqueous acidic cleaning composition at a temperature above 60° C. until the soap-contaminated conversion layer is removed from the metal workpiece and until a fatty acid formed from the soap in the conversion layer is dispersed in the aqueous acidic cleaning composition;

c) after step b), separating the metal workpiece from the aqueous acidic cleaning composition;

d) after step c), cooling the aqueous acidic cleaning composition to a temperature below 55° C. until a fatty acid layer comprising the fatty acid is separated from said aqueous acidic cleaning composition;

e) removing said fatty acid layer from said aqueous acidic cleaning composition to form a reusable aqueous acidic cleaning composition; and f) cleaning other metal workpieces with at least a portion of the reusable aqueous acidic cleaning composition.

2. The process as defined in claim 1, wherein said metal workpiece is an aluminum workpiece or an aluminum alloy workpiece and the soap-contaminated conversion layer consists of soap-contaminated calcium aluminate.

3. The process as defined in claim 1, wherein said aqueous acidic cleaning composition includes a surfactant.

4. The process as defined in claim 1, further comprising adding a predetermined concentration of said at least one acid ingredient in said aqueous acidic cleaning composition.

5. The process as defined in claim 3, wherein said surfactant is alkylamine ethoxylate.

* * * * *